US009731850B2

(12) United States Patent
Delage et al.

(10) Patent No.: US 9,731,850 B2
(45) Date of Patent: Aug. 15, 2017

(54) SYSTEM AND METHOD FOR PRESSURIZING A PLASTIC CONTAINER

(71) Applicant: Plastipak Packaging, Inc., Plymouth, MI (US)

(72) Inventors: Jean-Guy Delage, Le Havre (FR); Richard C. Darr, Medina, OH (US); Marc A. Pedmo, Litchfield, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 842 days.

(21) Appl. No.: 13/798,389

(22) Filed: Mar. 13, 2013

(65) Prior Publication Data

US 2013/0199130 A1 Aug. 8, 2013

Related U.S. Application Data

(63) Continuation-in-part of application No. 12/702,370, filed on Feb. 9, 2010, now Pat. No. 8,596,029.
(Continued)

(51) Int. Cl.
*B65B 31/04* (2006.01)
*B65B 31/00* (2006.01)
(Continued)

(52) U.S. Cl.
CPC ..... *B65B 31/00* (2013.01); *B65B 31/006* (2013.01); *B65B 61/24* (2013.01); *B67C 3/045* (2013.01);
(Continued)

(58) Field of Classification Search
CPC ..... B65B 31/04; B65B 31/041; B65B 61/24; B67C 3/045; B67C 3/222; B67C 2003/226
(Continued)

(56) References Cited

U.S. PATENT DOCUMENTS 4,040,233 A 8/1977 Valyi
4,293,359 A * 10/1981 Jakobsen ..... B29C 65/7858 156/156
(Continued)

FOREIGN PATENT DOCUMENTS

DE 195 20 925 A1 12/1996
FR 2 772 365 A1 6/1999
(Continued)

OTHER PUBLICATIONS

ISA/US Commissioner for Patents; International Search Report and Written Opinion issued in corresponding International Application No. PCT/US2013/042002. Date of Mailing: Oct. 1, 2013.

*Primary Examiner* — Gloria R Weeks
(74) *Attorney, Agent, or Firm* — Fishman Stewart PLLC

(57) ABSTRACT

A system for manufacturing a filled plastic container includes an actuator, a base unit including a heating surface, and a dispensing device or nozzle. The actuator includes a body portion and a holding/securing member configured to hold or secure a portion of the container. In embodiments, the actuator is configured to apply a force or pressure on the container to contact the base unit, the base unit is configured to receive a base portion of the container, the heating surface is configured to convey energy or heat to a portion of the base portion of the container, and the dispensing device or nozzle is configured to introduce an inert gas into the container. Methods for providing a filled plastic container and providing a thin-walled plastic container are also disclosed.

9 Claims, 16 Drawing Sheets

Related U.S. Application Data

(60) Provisional application No. 61/649,530, filed on May 21, 2012, provisional application No. 61/151,363, filed on Feb. 10, 2009.

(51) Int. Cl.
*B65B 61/24* (2006.01)
*B67C 3/04* (2006.01)
*B67C 3/22* (2006.01)

(52) U.S. Cl.
CPC ..... *B67C 3/222* (2013.01); *B67C 2003/226* (2013.01)

(58) Field of Classification Search
USPC ..... 53/79, 88, 471
See application file for complete search history.

(56) References Cited

U.S. PATENT DOCUMENTS 4,318,882 A 3/1982 Agrawal et al.
4,338,765 A 7/1982 Ohmori et al.
4,356,681 A 11/1982 Barnes
4,595,121 A 6/1986 Schultz
4,863,046 A 9/1989 Collette et al.
5,090,180 A * 2/1992 Sorensen ..... B29C 51/00 53/281
5,224,586 A * 7/1993 Naka ..... B65B 43/54 156/567
5,281,387 A 1/1994 Collette et al.
5,337,796 A * 8/1994 Ohmori ..... B65B 43/60 141/144
5,398,485 A * 3/1995 Osifchin ..... B65G 29/00 198/803.14
5,419,866 A 5/1995 Valyi
5,540,879 A 7/1996 Orimoto et al.
5,614,148 A 3/1997 Beck et al.
5,673,808 A 10/1997 Valyi et al.
5,735,420 A 4/1998 Nakamaki et al.
5,826,400 A * 10/1998 Martin ..... B65G 47/846 53/317
5,884,792 A 3/1999 Krishnakumar et al.
5,934,042 A * 8/1999 Peronek ..... B67B 3/2033 53/317
6,062,408 A 5/2000 Beck et al.
6,394,364 B1 5/2002 Abplanalp
6,502,369 B1 1/2003 Andison et al.
6,568,156 B2 5/2003 Silvers et al.
6,698,160 B2 * 3/2004 Peronek ..... B65B 7/2835 53/317
6,877,297 B2 * 4/2005 Armington ..... B31D 5/0047 53/168
7,159,374 B2 * 1/2007 Abercrombie, III ..... B65D 81/2046 206/219
7,219,480 B2 5/2007 Winters et al.
7,243,483 B2 * 7/2007 Clusserath ..... B67C 3/281 141/290
7,574,846 B2 * 8/2009 Sheets ..... B65D 1/0261 198/803.8
7,726,106 B2 * 6/2010 Kelley ..... B65B 21/12 53/290
8,011,166 B2 9/2011 Sheets et al.
8,028,498 B2 * 10/2011 Melrose ..... B65D 1/0276 215/376
8,528,304 B2 * 9/2013 Miyazaki ..... B65D 1/0261 53/127
8,596,029 B2 * 12/2013 Pedmo ..... B65B 61/24 53/471
2002/0004090 A1 1/2002 LaFleur
2002/0020149 A1 2/2002 Silvers et al.
2003/0110736 A1 6/2003 Boyd
2004/0131735 A1 7/2004 Korengel et al.
2005/0121408 A1 6/2005 Deemer et al.
2007/0051073 A1 3/2007 Kelley et al.
2007/0157563 A1 7/2007 Ruppman, Sr. et al.
2008/0289299 A1 * 11/2008 Mansson ..... B65B 31/00 53/403
2009/0130274 A1 5/2009 Iwashita et al.
2009/0218003 A1 * 9/2009 Miyazaki ..... B67C 3/045 141/4
2010/0018166 A1 1/2010 Outreman
2010/0199611 A1 8/2010 Pedmo et al.

FOREIGN PATENT DOCUMENTS

FR 2 887 238 A1 12/2006
FR 2896232 A1 7/2007
JP 2008-178994 8/2008
WO 90/07451 A1 7/1990
WO 2007127337 A2 11/2007
WO 2008/004458 A1 1/2008

* cited by examiner

SYSTEM AND METHOD FOR PRESSURIZING A PLASTIC CONTAINER

CROSS-REFERENCE TO RELATED APPLICATION

This application claims the benefit of priority to U.S. Provisional Application No. 61/649,530, filed May 21, 2012, the entire disclosure of which is incorporated herein by reference. This application is also a continuation-in-part of and claims priority to U.S. Utility application Ser. No. 12/702,370, filed Feb. 9, 2010, currently pending, which claims the benefit of U.S. Provisional Application No. 61/151,363, filed Feb. 10, 2009.

TECHNICAL FIELD

The present invention relates to a system and method for pressurizing a plastic container.

BACKGROUND

With light-weighting initiatives creating thinner container walls, manufacturers have attempted to alleviate associated problems with container strength reductions. Thin walled plastic containers can be prone to deforming or "ovalization," and may not be suitable for vending purposes as the force from such a drop can cause container rupture. Also, over a period of time, thin-walled containers with liquid contents can lose a fraction of their contents more rapidly than comparatively thicker-walled containers, which can lead to increased internal vacuum and deformation.

Thin walled plastic containers can be used for many purposes, including being filled with "hot" or "cold" contents. With "hot-fill" packages, containers are commonly filled with a heated or "hot" liquid product and capped while the product contents remain at an elevated temperature. As the product contents cool, the associated reduction in the volume of the contents can create a vacuum pressure within the container—i.e., an internal pressure that is less than the surrounding atmospheric pressure. If the container is comprised of a molded plastic, portions of the container walls may distort inwardly as the contents cool.

To address these concerns associated with containers, including thin-walled containers, whether for either "hot" or "cold" filling applications, some conventional containers are filled with an inert gas, such as nitrogen, prior to capping. This method adds internal pressure and external rigidity for a time. Further, some containers provide ribs, grooves, or relatively thicker wall portions on the container walls to strengthen the walls so as to reduce the effects of distortion. Still others may additionally utilize one or more vacuum panels to help account for or otherwise control the amount of distortion associated with an anticipated vacuum pressure. However, in addition to increasing the complexity of the container and manufacturing process, some or all of the aforementioned measures may be seen as aesthetically displeasing and/or may require additional material, which can contribute to increased weight and cost.

SUMMARY

A system for manufacturing a plastic container, which may include a thin-walled container, includes an actuator and a base unit. The actuator may include a body portion and a holding/securing member configured to hold or secure a portion of a container. The base unit includes a heating surface and may optionally include an insert. In an embodiment, the actuator may be configured to apply a force or pressure on a container to contact the base unit, the base unit may be configured to receive a base portion of the container, the heating surface may be configured to convey energy or heat to a portion of the base portion of said container, and, for some embodiments, the headspace of the container may additionally be dosed (e.g., with liquid nitrogen or an inert gas) prior to capping. Embodiments of a method for manufacturing a filled plastic container and for providing a thin-walled plastic container are also disclosed.

BRIEF DESCRIPTION OF THE DRAWINGS

Embodiments of the disclosure will now be described, by way of example, with reference to the accompanying drawings, wherein.

DETAILED DESCRIPTION

Reference will now be made in detail to embodiments of the present disclosure, examples of which are described herein and illustrated in the accompanying drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
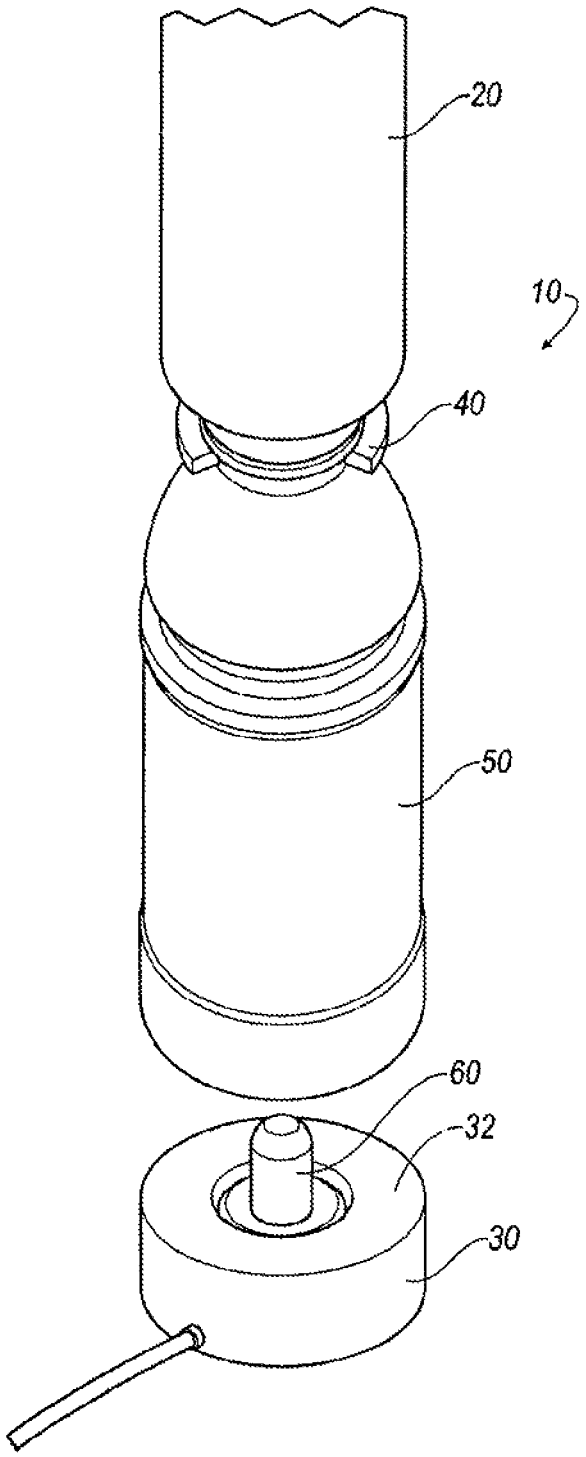
FIG. 1 is a perspective view representation of an embodiment of a system for pressurizing a container.

FIG. 1 generally illustrates a pressurizing system 10 in accordance with an embodiment of the present invention. The system 10 includes an upper component, or actuator 20, and a lower component, or base unit 30. The actuator 20 may include a holding/securing member 40 for holding and/or securing a portion of a container 50, and the base unit 30 may include principal heating surface 32 and a centering formation 60 that may, for example, take the form of a centering pin. Embodiments of the system and the methods disclosed herein may be employed in connection with various types of plastic containers, including thin-walled plastic containers. Such "thin-walled" plastic containers may include, for example, containers with wall thicknesses from about from about 0.12 mm (about 4.724409 mil) to about 0.31 mm (12.20472 mil), or less, and would include containers with walls within a subset range of from about 0.17 mm (6.692913 mil) to about 0.26 mm (10.23622 mil) thick.

In embodiments of the invention, the actuator 20 may move in at least one direction (e.g., linearly up-and-down) and may be controlled by various known power-control configurations. By way of example, without limitation, movement associated with the actuator 20 may be pneumatically controlled, hydraulically controlled, servo controlled, and/or controlled by an electric motor or drive system. As generally shown in FIG. 1, and additionally illustrated in FIGS. 2A, 2B, and 3, the actuator may include a holding/securing member 40. The holding/securing member 40 may, for example, be in the form of an open-faced (e.g., "C"-shaped) formation that is configured to hold and/or secure a portion of a container—such as an upper/neck portion of a container.

Figure 2A:
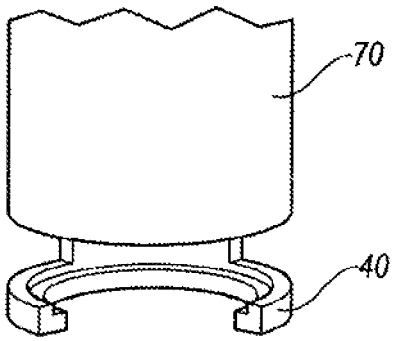
FIG. 2A is a general representation of a portion of an actuator that may used in connection with systems according to an embodiment, the holding/securing portion of the actuator shown in a first position.
Figure 2B:
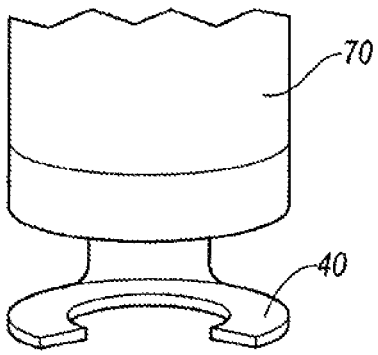
FIG. 2B is a general representation of a portion of an actuator that may used in connection with systems according to an embodiment, the holding/securing portion of the actuator shown in a second position.

Moreover, as generally illustrated in the embodiments shown in FIGS. 2A and 2B, the holding/securing member 40 may be provided in different configurations and, if desired to facilitate its holding/securing function, may be controllably translated or moved relative to an associated actuator body, generally designated 70. In an embodiment, the holding/securing member 40 may be movable (e.g., back and forth) along at least one direction relative to the actuator body 70. For example, without limitation, the holding/securing member 40 is generally shown in FIG. 2A in a first (e.g., comparatively "retracted") position, and is shown in FIG. 2A in a second (e.g., comparatively "extended") position. Such "retracted" positioning may be beneficial or desirable for holding/securing during processing, while such comparatively "extended" positioning may be beneficial for acquiring or releasing a container.

Figure 3:
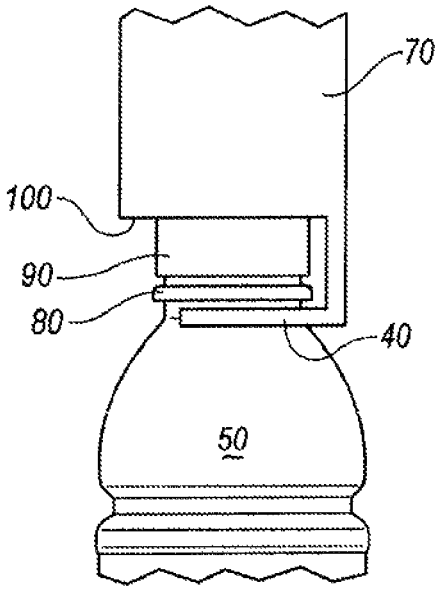
FIG. 3 is a general representation of an actuator of the type illustrated in FIGS. 2A and 2B shown holding/securing a plastic container.

As generally illustrated in FIG. 3, in embodiments, the actuator 20 may be configured such that a holding/securing member 40 is configured to retain and/or support a support flange 80 of an upper portion of container 50. Further as generally illustrated in FIG. 3, the holding/securing member 40 may be integral or formed in a unitary manner with the actuator body 70; the holding/securing member 40 may be configured to slide underneath a support flange 80; and/or a closure 90 associated with the container 50 may, upon being retained and/or supported by the holding/securing member, at some point thereafter be in (or may be urged into) contact with a lower surface 100 of the actuator body 70.

Figure 4:
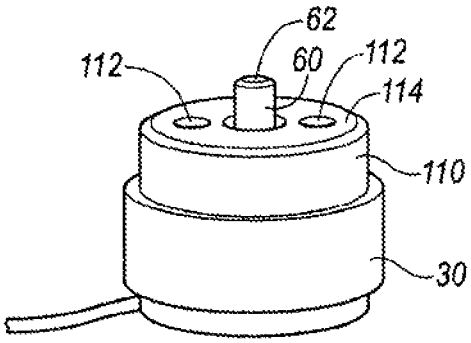
FIG. 4 is a general representation of a base unit according to an embodiment of the disclosure.

FIG. 4 generally illustrates an embodiment of a base unit 30. As shown in the illustrated embodiment, the base unit 30 may include a centering formation 60. In an embodiment, the centering formation 60 may be adjustable—e.g., in a vertical direction—with respect to the base unit 30. By way of example, without limitation, the centering formation 60 may be spring-loaded or otherwise outwardly biased in a vertical direction such that when a base of a container comes into contact with the centering formation 60, the centering formation 60 will adjust (i.e., provide a measure of "give" toward the base unit 30) while remaining in contact with the base of the container. In an embodiment, the centering formation may be configured to, among other things, operatively engage a portion of the base of a container (e.g., a container base dome) to prevent or reduce the amount of horizontal movement or sway associated with the container. Moreover, for some embodiments, the head or tip 62 of the centering formation 60 may be configured to interface for a more rigid or firm engagement with a portion of the base of an associated container.

As generally shown in FIG. 4, an insert 110 may be included with the base unit 30. An insert 110 can, be optionally included, for example, to configure the associated system to accommodate containers with different vertical lengths. If desired, the insert can be firmly, yet removably connected to the base unit 30, such as for example via one or more screw holes 112. In an embodiment, at least a portion of the insert 110 can be configured to provide (e.g., conduct) energy or heat provided from the base unit 30 to a base portion of a container—for instance via portions of surface 114. In embodiments of the system 10, the energy or heat may be electrically-derived heat or may comprise other forms of conductive-type energy or heat.

Figure 6:
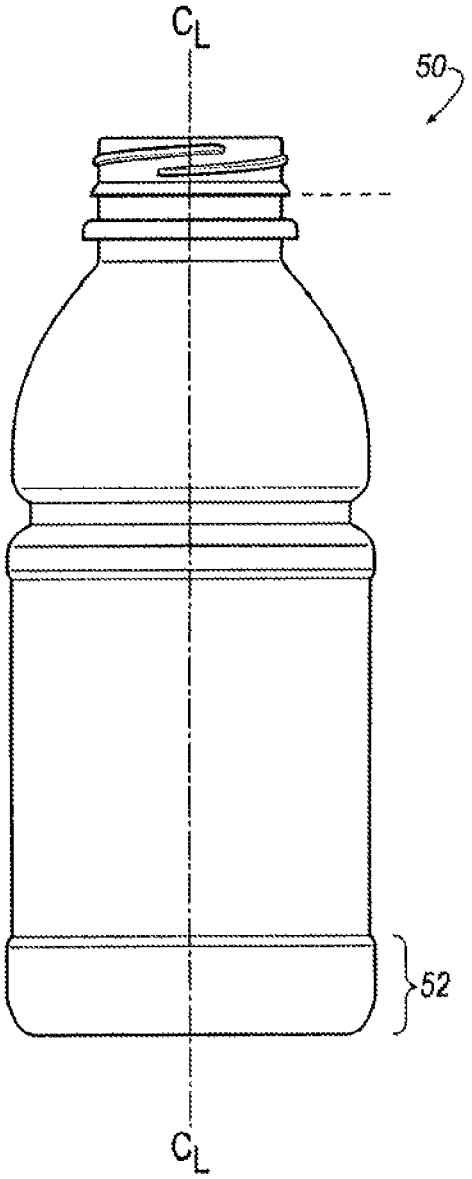
FIG. 6 generally illustrates a side elevation view of a plastic container of the type that may be used in connection with embodiments of the disclosure.
Figure 7:
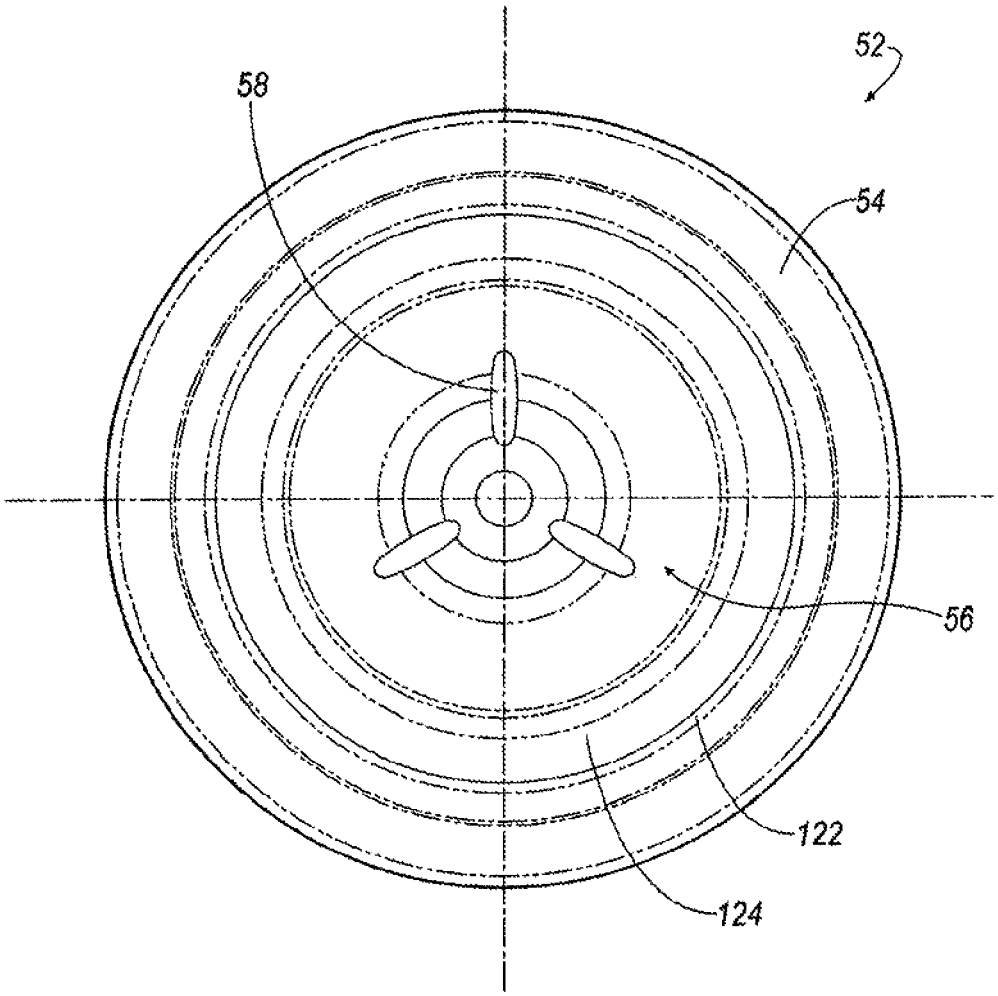
FIG. 7 is a bottom plan view of a container base portion according to an embodiment of the disclosure.

FIG. 6 generally depicts an embodiment of a plastic container 50 that might, for example, be accommodated by an embodiment of the system 10. The plastic container 50 includes a base portion 52, such as that generally illustrated in FIG. 7. However, it is noted that the present invention is not limited to the illustrated embodiment, and various other base configurations may be employed with the invention. As generally illustrated, and without limitation, the base portion 52 may include an annular support surface 54 that can be configured to support a plastic container 50 on an external surface. The base portion 52 may also include a central portion 56, which may include a domed or elevated portion—including those provided in connection with various conventional container base designs. Further, it is noted that the base portion 52 may optionally include one or more various other formations, such as, by way of example, structural reinforcing formations 58.

Figure 8A:
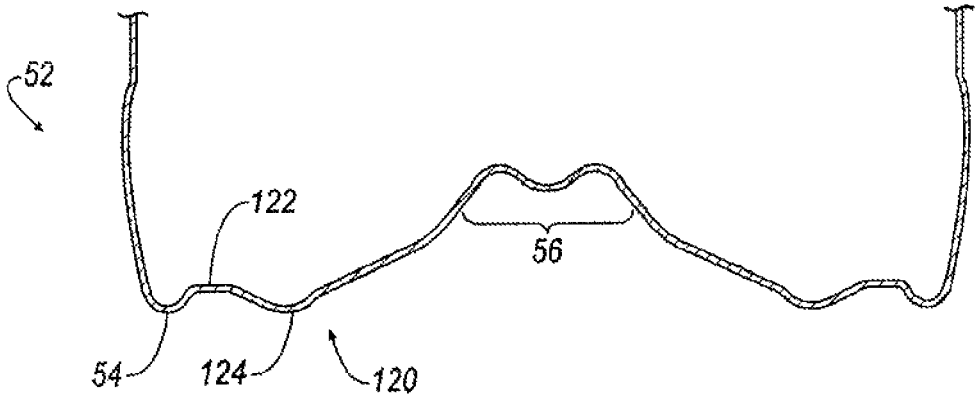
FIG. 8A is a side view outline of a container base portion according to an embodiment of the disclosure, shown prior to incurring internal vacuum pressure.
Figure 8B:
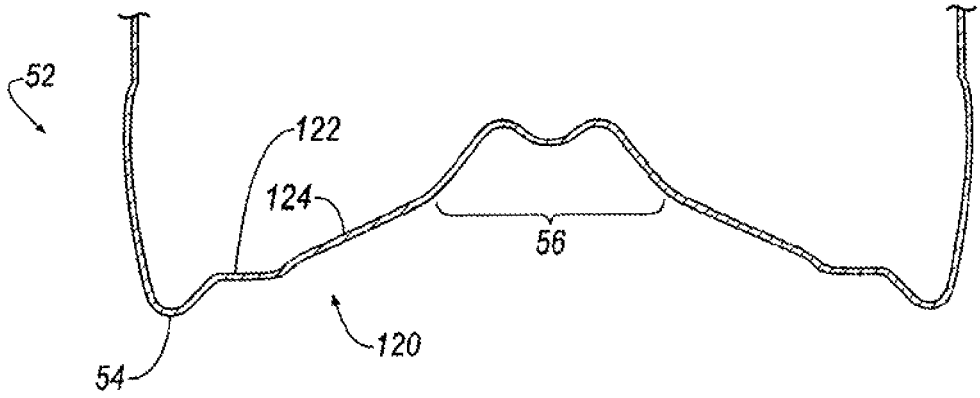
FIG. 8B is a side view outline of a container base portion according to an embodiment of the disclosure, shown after the effect of internal vacuum pressure.

As generally illustrated in the embodiment of a base portion 52 shown in FIGS. 8A and 8B, the base portion may include a transition segment or portion (generally designated 120) between the annular support surface 54 and the central portion 56. The transition segment or portion 120 may, as generally illustrated, include one or more steps 122, and may include one or more flexible or inversion segments or portions 124. FIG. 8A generally illustrates a side view outline of a container base portion 52 according to an embodiment providing hot-filled contents to the container, shown prior to incurring internal vacuum pressure. FIG. 8B generally illustrates the base portion 52 after incurring an internal vacuum pressure, such that the illustrated inversion section or portion 124 has moved upwardly (e.g., to be more concave) in response to at least a portion of the vacuum pressure.

Turning again to FIG. 4, in an embodiment, at least a portion of the base unit, or insert 110 (if an insert is utilized), may be configured to conduct energy or heat to specific/select portions of the base portion 52 of a container 50. By way of example, the conducting surface—whether that of a base unit or insert—that contacts the base portion 52 of the container 50 may be configured to supply energy or heat to all or a part of a portion or segment disposed between annular support surface 54 and a central portion 56. In an embodiment, the aforementioned contacting surface of the base unit (or insert) may be in contact with a substantial portion of a flexible or inversion segment or portion (e.g., 124 in FIGS. 8A and 8B). The system thus permits the controllable application of energy or heat to a select portion or portions of base portion 52.

Figure 5C:
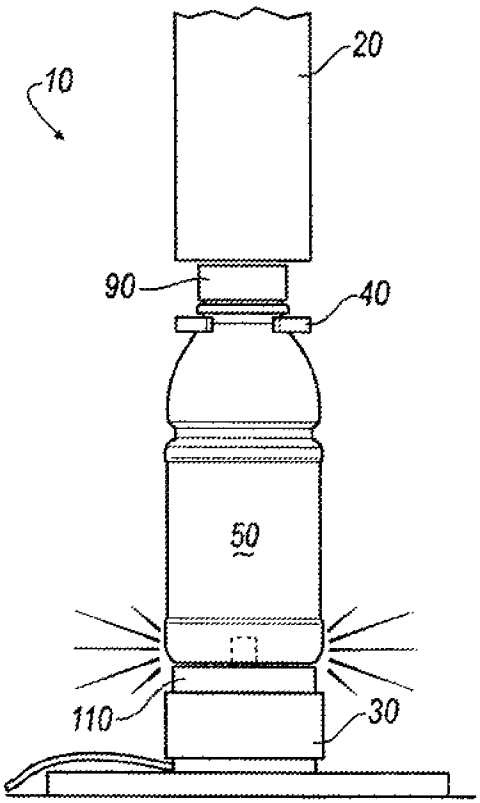
FIGS. 5A through 5C generally illustrate process stages associated with a system in accordance with an embodiment of the disclosure.
Figure 5B:
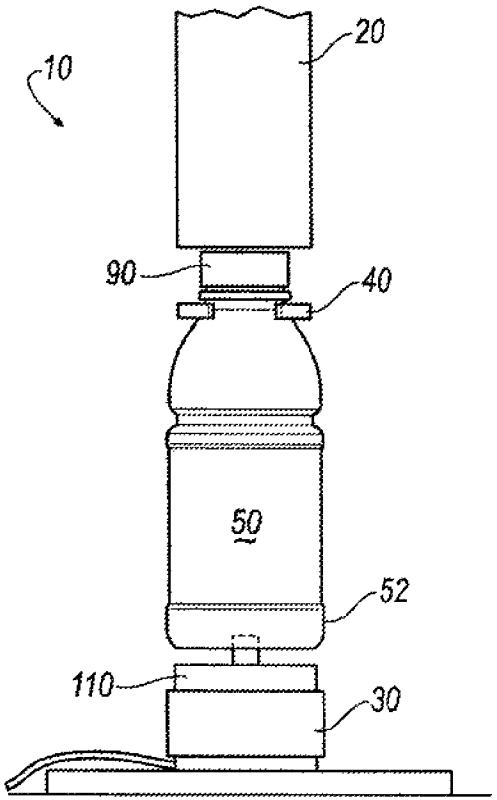
Figure 5A:
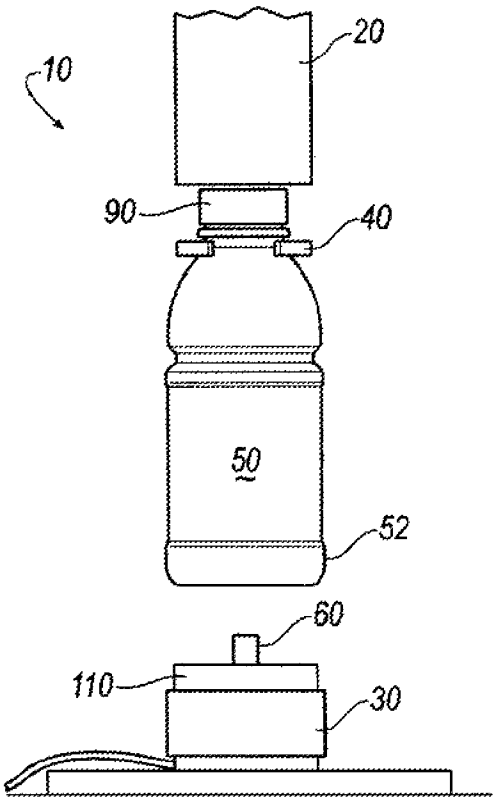

A method or process associated with an embodiment of the invention is generally represented in FIGS. 5A through 5C. As generally illustrated in FIG. 5A, an actuator including a holding/securing member 40 may acquire a container 50 having a base portion 52. At this stage in the processing, the container 50 has been filled with contents (e.g., at an elevated temperature from at least 150° F. to 210° F. (65° C. to 98.9° C.), and for some embodiments at an elevated temperature from at least 170° F. to 180° F. (77° C. to 82° C.)), and the container has been sealed and a closure (e.g., closure 90) has been applied. The container 50 may be cooled to a degree—to for example, for some embodiments between about 70° F. (21.1° C.) and about 120° F. (49° C.), and for other embodiments between about 80° F. (27° C.) and about 120° F. (49° C.), which may result in just a slight container deformation. It is noted that, depending upon the areas of "least resistance," portions of the sidewall of the container may distort (e.g., be pulled or sucked inwardly) in response to internal vacuum pressures associated with the cooling of the contents of the container 50. The container 50 may then be moved into position with respect to a base unit 30 and centering formation 60. The illustrated system 10 is shown involving the use of an insert 110, which may be optional for a number of applications. The insert 110 is shown provided about the centering formation 60 on the base unit 30. In embodiments of the system, the vertical distance (or travel spacing) between the lowermost portion of the base portion 52 of the container 50 and the top of the base unit 30 (or the insert 110, if present), may, without limitation, be three inches or less. For some embodiments, longer stroke cylinders may be employed. It is noted that by minimizing or reducing the distance that the container base 52 must to travel to contact or engage the base unit 30, cycle time may be correspondingly be reduced.

As shown in connection with the embodiment illustrated in FIG. 5B, the actuator 20 may move container 50 toward the base unit 30 and a centering formation 60. The base portion 52 of the container 50 eventually will contact and/or engage the centering formation 60, which may be configured to retract (or provide a measure of "give" until the base portion 52 comes into operative communication/contact with the base unit 30 and/or insert 110 (to the extent that an insert is provided).

As generally illustrated in FIG. 5C, portions of the container 50 may be moved into operative contact or communication with the actuator 20 and the base unit 30 and/or insert 110. The actuator 20 may exert a measure of downward pressure or force on a portion of the container 50 (e.g., closure 90) and at least a portion of the base portion 52 of the container may come into contact with a conductive portion or region of the base unit 30 and/or insert 110 that is configured to conduct energy or heat. In an embodiment, a heat or energy with a temperature of at least about 200° F. is applied from the base unit 30 to the container base portion 52. In an embodiment, for example and without limitation, the conductive portion may provide about 450° F. to the select area of the base portion 52. The base unit 30 may apply heat to the container base for about 1 to 6 seconds, and for some embodiments for about one second or less. The actuator 20 may, for example, apply a downward top pressure of from about 30 pounds-force (133 N) to about 190 pounds-force (845 N). Without limitation, some embodiments will nominally apply about 125 pounds-force (556 N). Such top pressure/force may, among other things, help to stabilize internal pressure and urge the sidewalls of the container back into place, as well as help make the base more rigid (due to associated plastic memory, the walls of the base will now tend not to push back) and generally increase container strength. The system thus provides a measure of controllable downward pressure and application of energy and/or heat that can be controlled or adjusted separately or in various combinations. In embodiments of the invention, the total cycle time associated with the processes generally illustrated in FIGS. 5A through 5C may be two to eight seconds (and may be three to four seconds, or less), and the time in which the base portion 52 of the container 50 is in contact with the base unit 30 and/or insert 110 may be as little as one second or less.

Figure 9A:
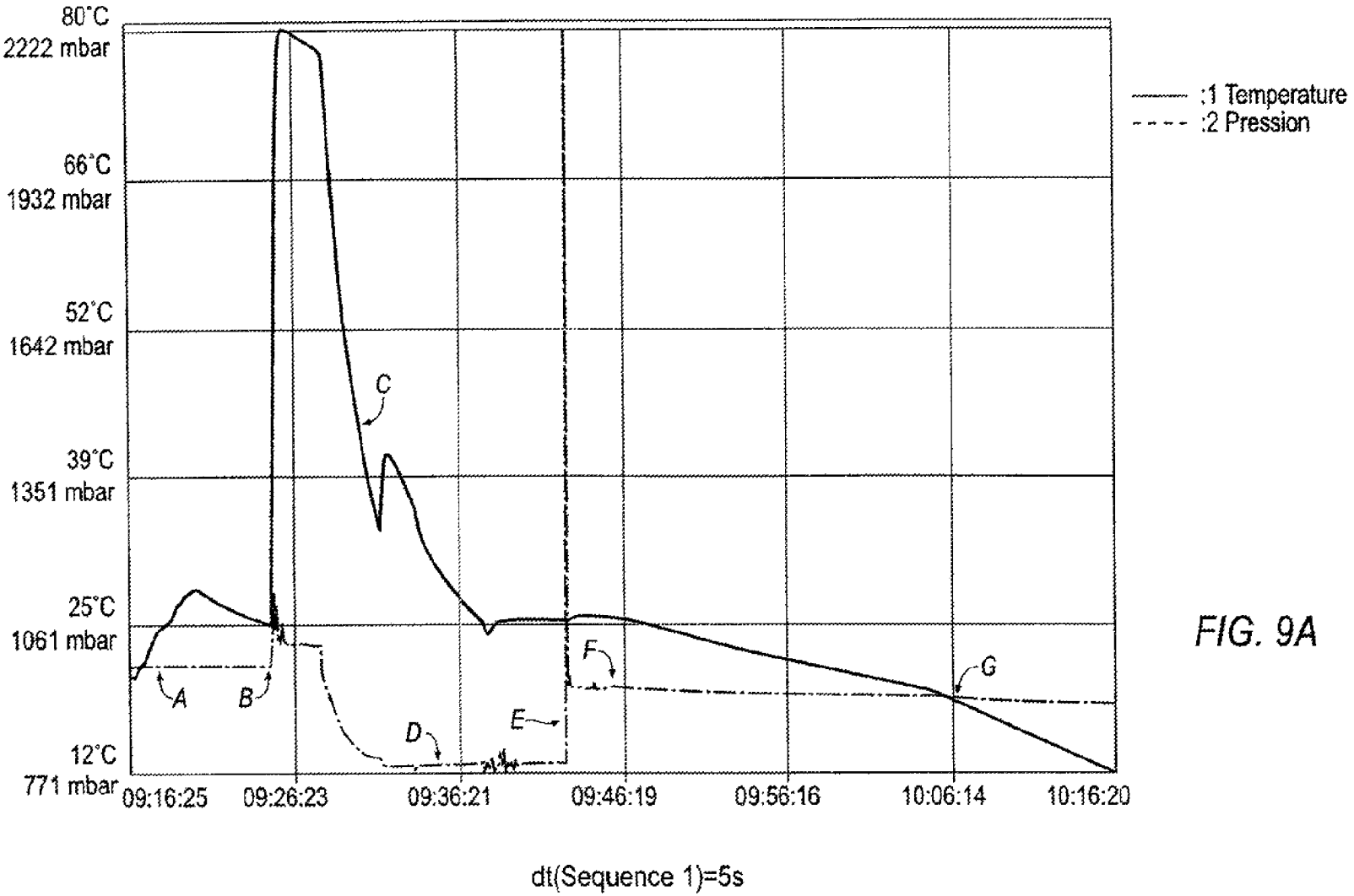
FIG. 9A is a chart generally illustrating temperature and pressure profiles associated with a process in accordance with an embodiment of the disclosure.
Figure 9B:
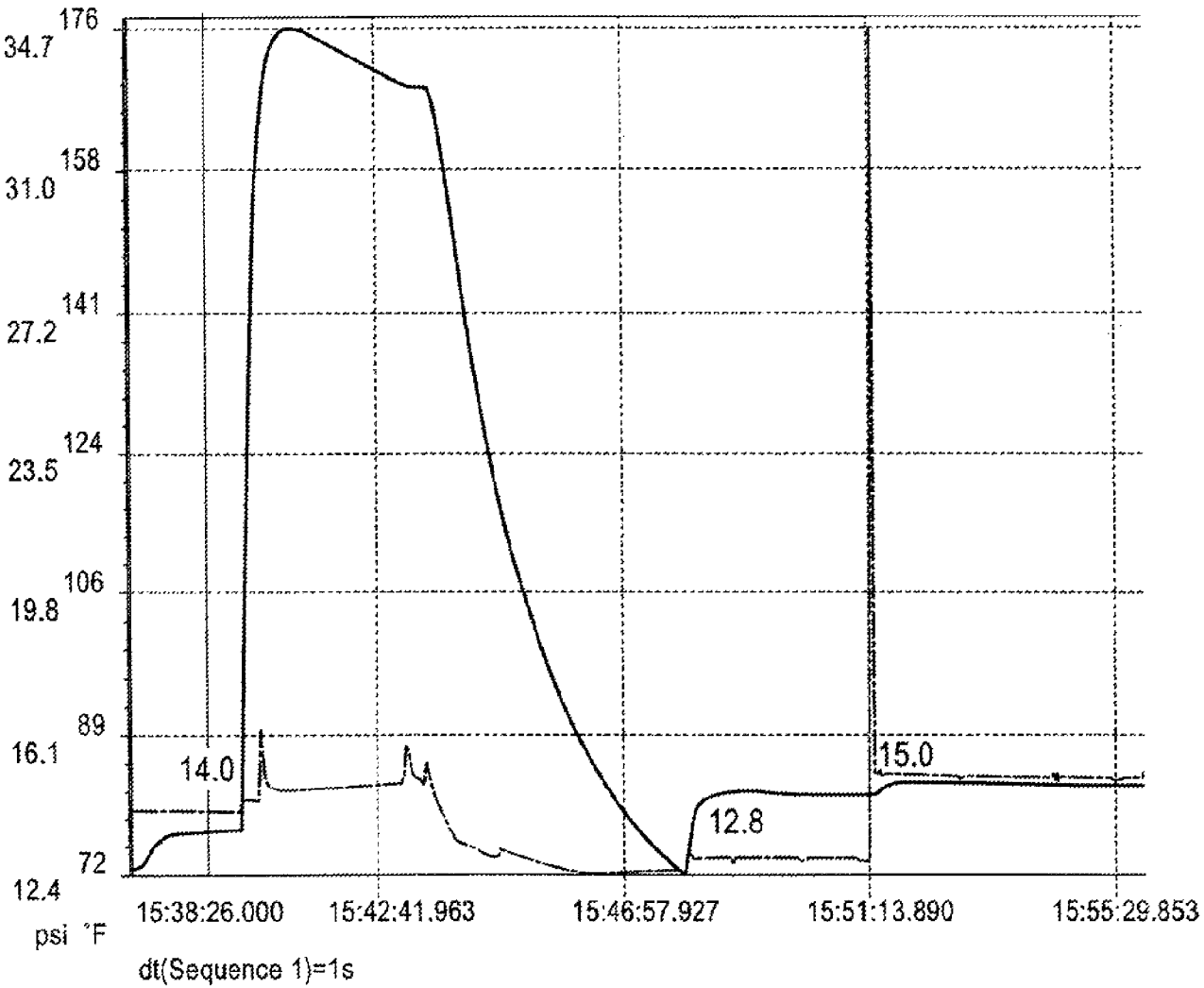
FIG. 9B is a chart generally illustrating temperature and pressure profiles associated with a process in accordance with another embodiment of the disclosure.

A chart generally illustrating temperature and pressure profiles that may be associated with a process in accordance with a "hot-fill" embodiment of the present invention is shown in FIG. 9A. Turning to the chart, at point A, a plastic container is delivered to a fill site. The fill site may, for instance, be at or about an atmospheric pressure of, for example, 979.056 mbar (14.2 psi). Along the segment generally identified as B, the container may be filled with contents at an elevated temperature and then may be sealed/capped (the maximum temperature for some embodiments may be about 80° C. (176° F.)). At or about the start of segment C, which may begin just after the apex of the temperature associated with hot-filling is reached, the container may begin an assisted cooling (e.g., in connection with a cooling tunnel or cold bath), with the temperature dropping from, for example, about 80° C. (176° F.) to about 30° C. (86° F.) in five to six minutes or less. The decline in temperature may correspond with the internal pressure becoming negative, and producing an internal vacuum, with the pressure, for example, dropping to at or about 786.002 mbar (11.4 psi) (near point D). Around that pressure, the temperature for the illustrated embodiment is now around or about 25° C. (77° F.). At or about point E, the container base portion is inverted with the application of pressure and/or heat—for example in connection with the previously described system. The charted embodiment shows the internal pressure spiking at this "moment of inversion" to, for example, about 2220.112 mbar (32.2 psi) and quickly subsequently dropping off. It is noted that, depending on the configuration of the container, it may not be necessary to use this much pressure to invert the base portion. At or about point F, the pressure begins to normalize to about 917.003 mbar (13.3 psi). Moreover, due to the associated inversion associated with the container base, the pressure will start to stabilize closer to atmospheric pressure. By around point G, the temperature may tend to drop further, for example, to below the reading of about 18° C. (64.4° F.), but the internal pressure will remain fairly consistent at or around 917.003 mbar (13.3 psi) and will commonly—unless subjected to unusual environmental conditions—not move much at all thereafter. FIG. 9B includes a chart generally illustrating temperature and pressure profiles that may be associated with a process in accordance with another embodiment of the system.

Figure 10:
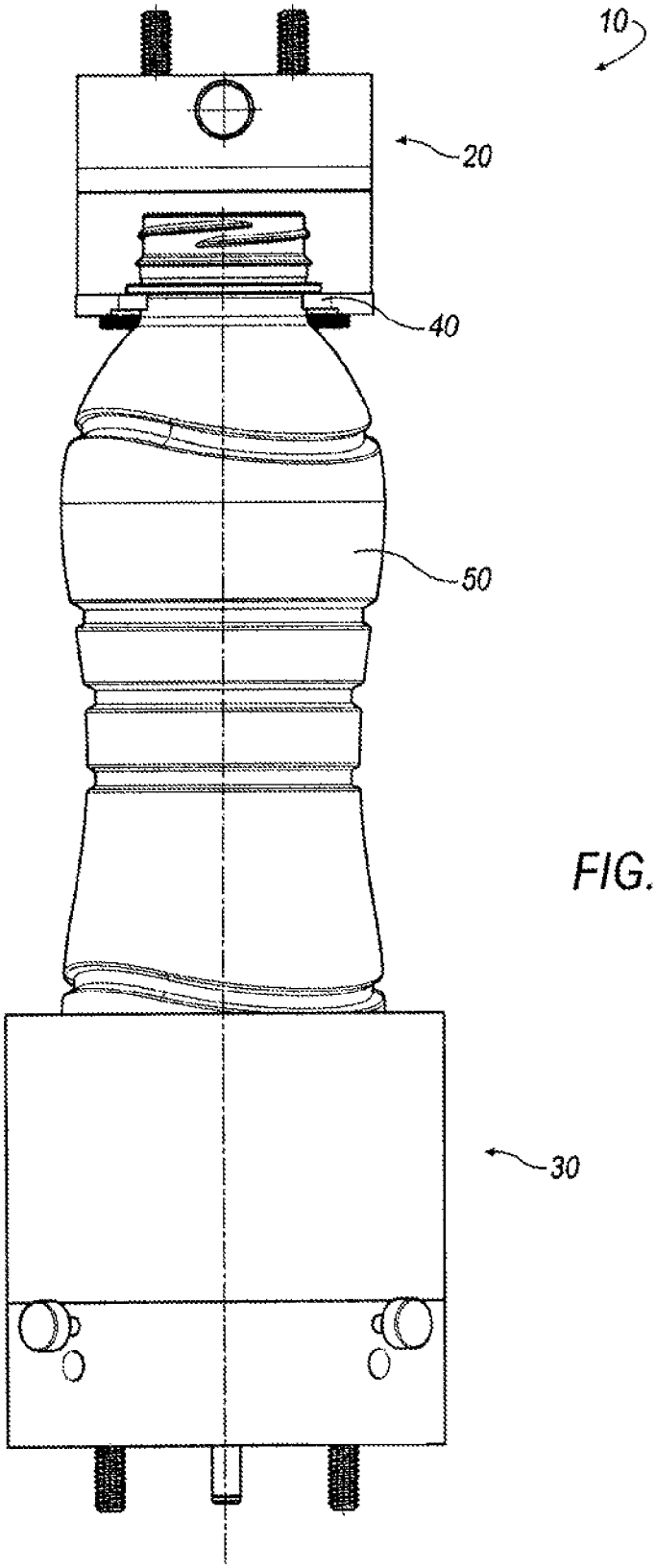
FIG. 10 is a front elevation view of an embodiment of a system for pressurizing a container.
Figure 11:
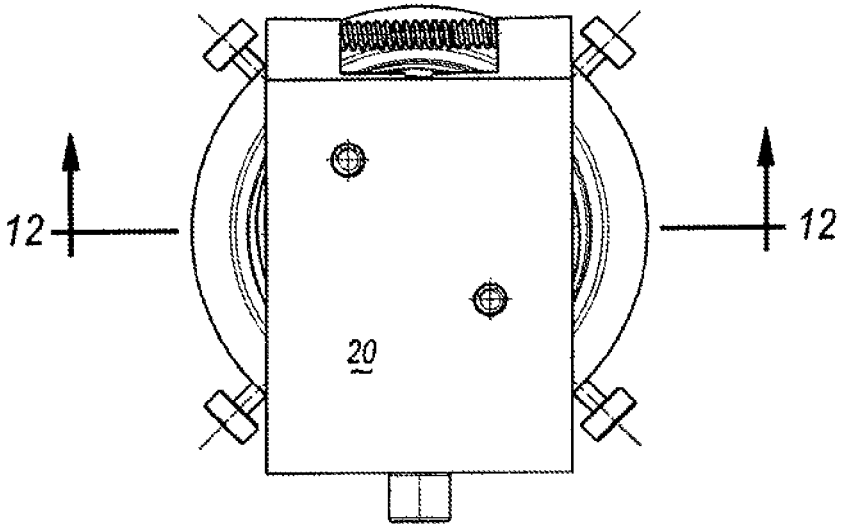
FIG. 11 is a top view of the system illustrated in FIG. 10.

FIG. 10 generally illustrates a pressurizing system 10 in accordance with another embodiment of the present invention. The system 10 includes an upper component, or actuator 20, and a lower component, or base unit 30. The actuator 20 may include a holding/securing member 40 for holding and/or securing a portion of a container 50. FIG. 11 illustrates a top view of the system shown in FIG. 10.

Figure 12:
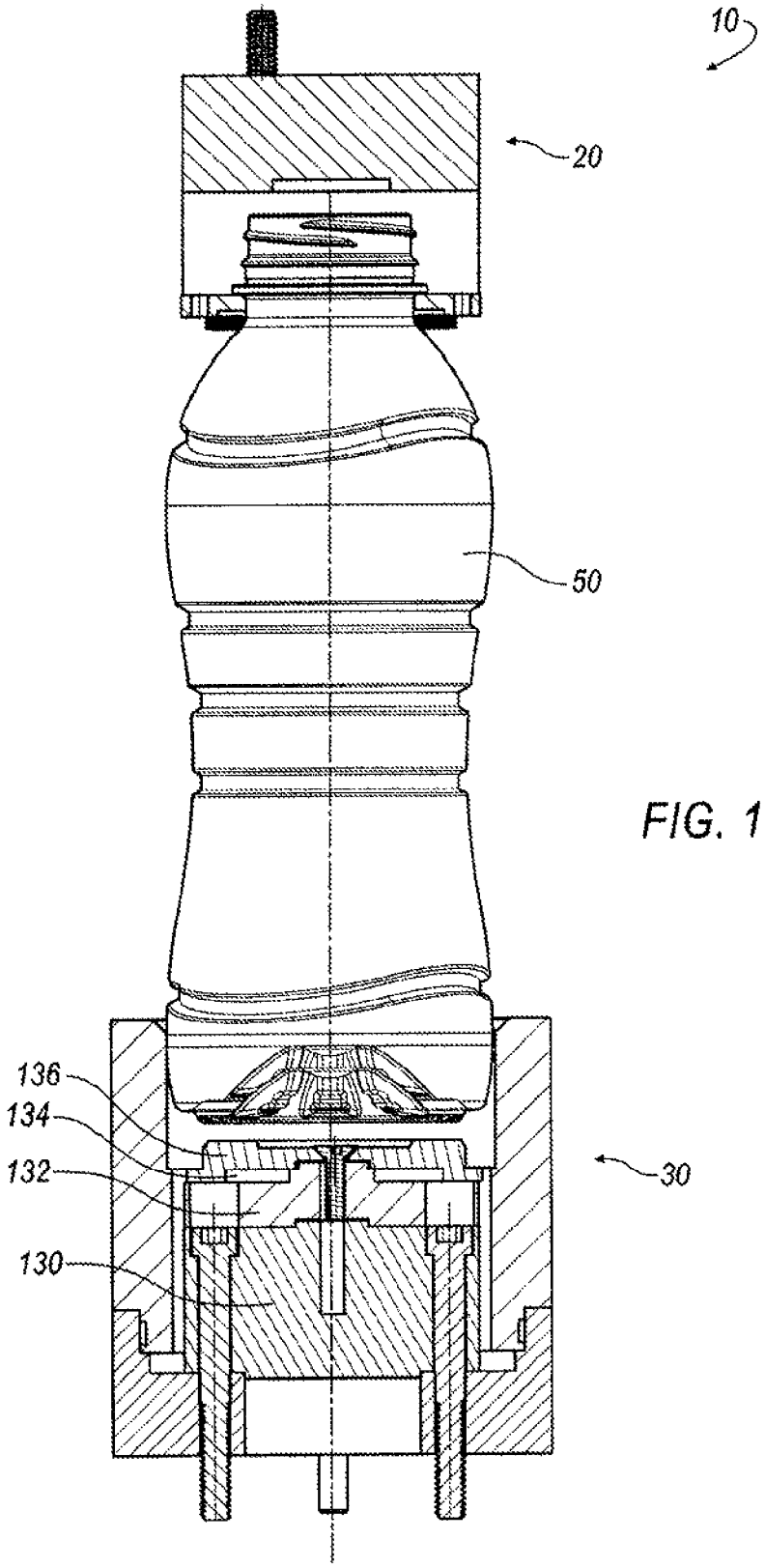
FIG. 12 is a sectional view of the system illustrated in FIG. 10, viewed in the direction of section 12-12.
Figure 13:
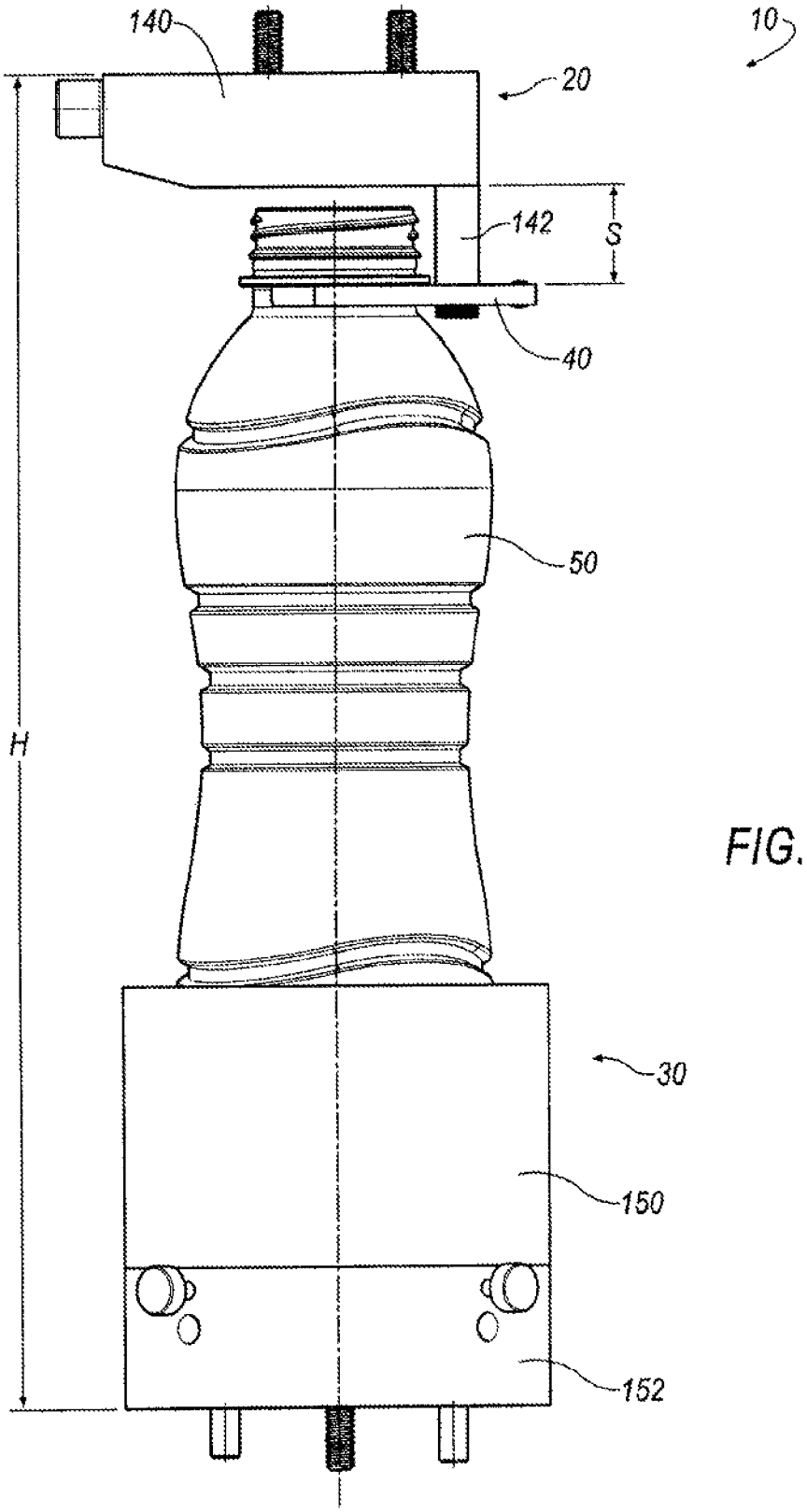
FIG. 13 is a side elevation view of the system illustrated in FIG. 10.

FIG. 12 provides a sectional view of the system 10 shown in FIG. 10, and shows aspects of the base unit 30 in additional detail. As illustrated, an embodiment of the base unit may include a spacer 130, a top insulator 132, a heater or heating element (e.g., a ceramic heater) 134, and a cap 136. It is noted that embodiments of the system may employ several types of heaters including, without limitation, resistant, inductive, or gas (which could come in the form of rod, coil, band, or disk), and which may be comprised of several materials (including ceramic, metal, or composite). FIG. 13 shows the system 10 from a different (side) view. The illustrated system 10 shows an actuator 20 that includes, inter alia, a hanger block 140, a bottle neck spacer 142, and a holding/securing member 40 (in the form of spaced grippers) for holding and/or securing a portion of bottle 50. The spacer 142 can be configured to provide a sufficient space S for accepting an uppermost portion of the container 50. By way of example, without limitation, the space S provided in connection with a 500 ml bottle might be in the order of 0.880 inches. The base unit 30 of the illustrated embodiment is shown including centering ring 150 and a sleeve 152. As generally illustrated, the assembly 10 may have a total height H that, for some embodiments may be less than 12 inches. However, the assembly is not limited to a specific height, and the height (as well as other dimensions of the system) can be configured/adjusted to accommodate an intended container size.

Figure 14:
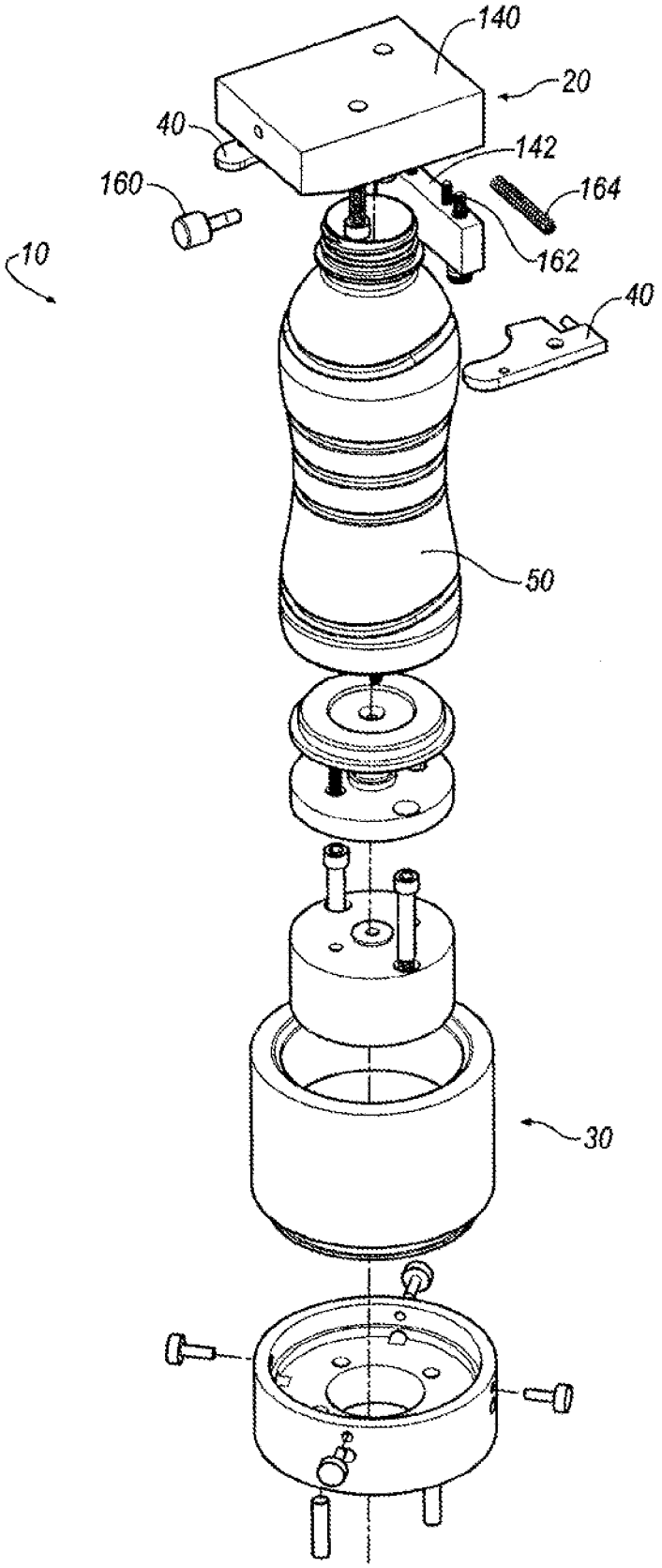
FIG. 14 is a perspective assembly/exploded view of an embodiment of a system.
Figure 15:
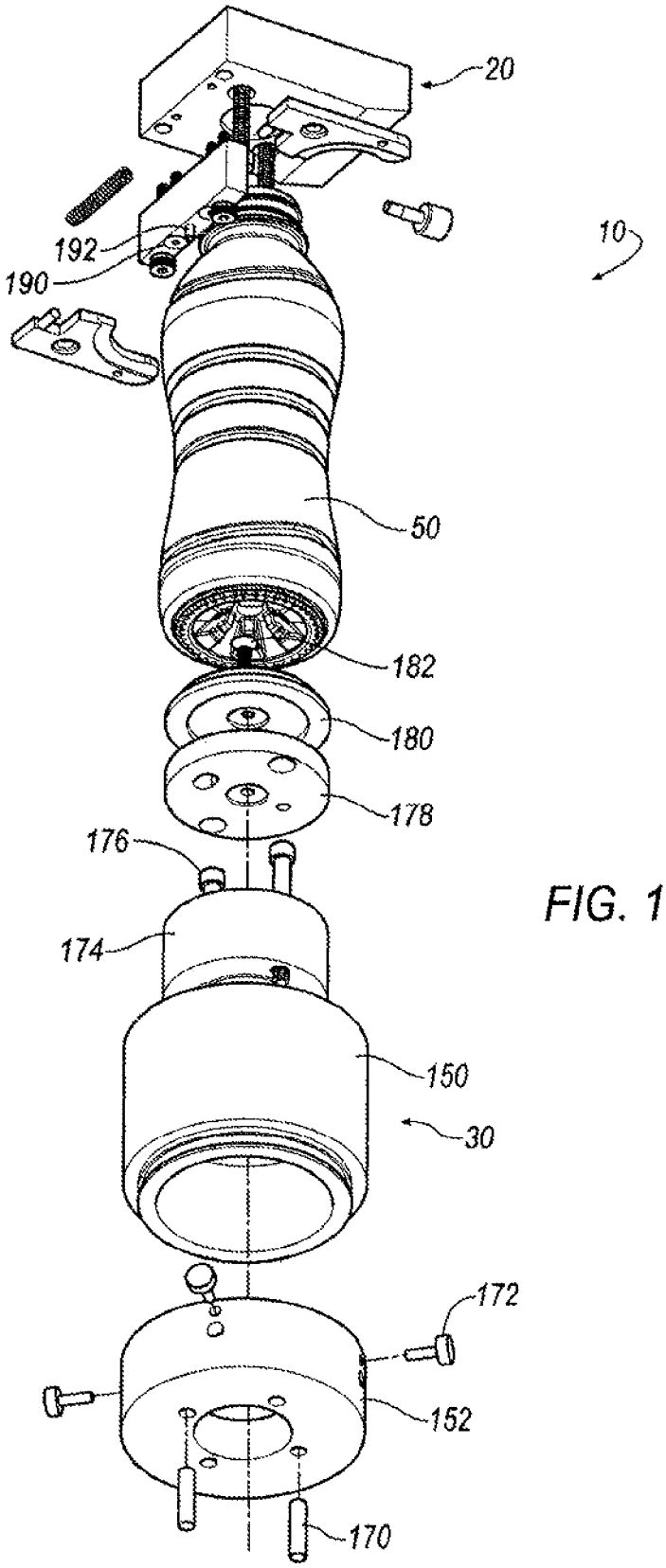
FIG. 15 is a perspective assembly/exploded view of the embodiment of a system shown in FIG. 14, shown from a different direction.

FIGS. 14 and 15 show assembly/exploded views of an embodiment of the system 10, shown from two different perspectives. The figures show elements of the system 10, including embodiments of an actuator 20 and a base unit 30 in further detail. As illustrated in FIG. 14, the actuator 20 may include a multi-component holding/securing member 40 (shown with left and right components), a track roller/stud mount 160, a shoulder screw 162, and a spring 164 (e.g., a compression spring). As illustrated in FIG. 15, an embodiment of the base unit 30 may include dowel pins 170, screws 172 (e.g., thumb screws), a base unit spacer 174, a screw head (e.g., a socket head cap screw) 176, an insulator 178, and a cap 180 (which may, for example be secured by a screw 182). With respect to the actuator 20, FIG. 15 also shows a cap screw 190 and dowel pin 192.

With embodiments of the invention, an initial vacuum pressure may, for example and without limitation, be about −3 psi. It is, however, noted that the initial value will change depending upon the resistance associated with the respective container, i.e., containers that are more structurally rigid may require a higher initial internal vacuum. Embodiments of process associated with the invention can help maintain the encountered pressure within +/−2 psi from atmospheric pressure. That is, the desired final filled container internal pressurization may be within the range of −2.0 psi to 2.0 psi of atmospheric pressure. Moreover, for some embodiments, the final filled internal pressure may be maintained within +/−1 psi from atmospheric pressure. For many embodiments of the system a positive atmospheric pressure is considered more desirable than a negative one. Further, for example and without limitation, if atmospheric pressure at a filling location is about 14.0 psi, the present system and process can provide a resulting filled and closed container that has an internal pressure within the range of 12.0 psi and 16.0 psi, and may provide for containers with such internal pressures between 13.0 psi and 15.0 psi.

Figure 16:
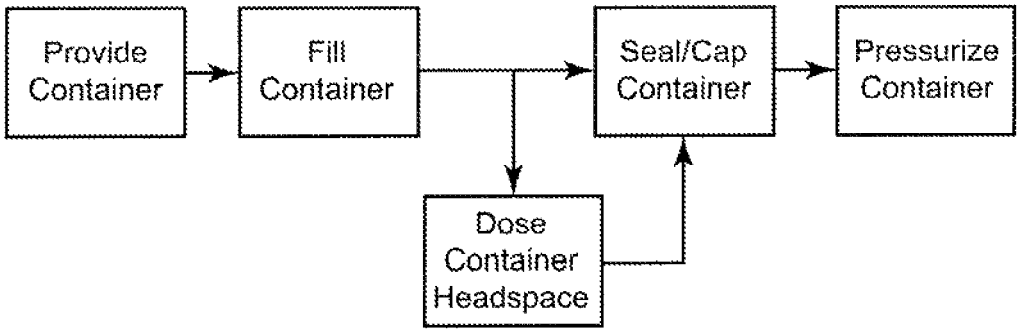
FIG. 16 is a flowchart generally describing an embodiment of a system that involves dosing the headspace of a container prior to capping.
Figure 17:
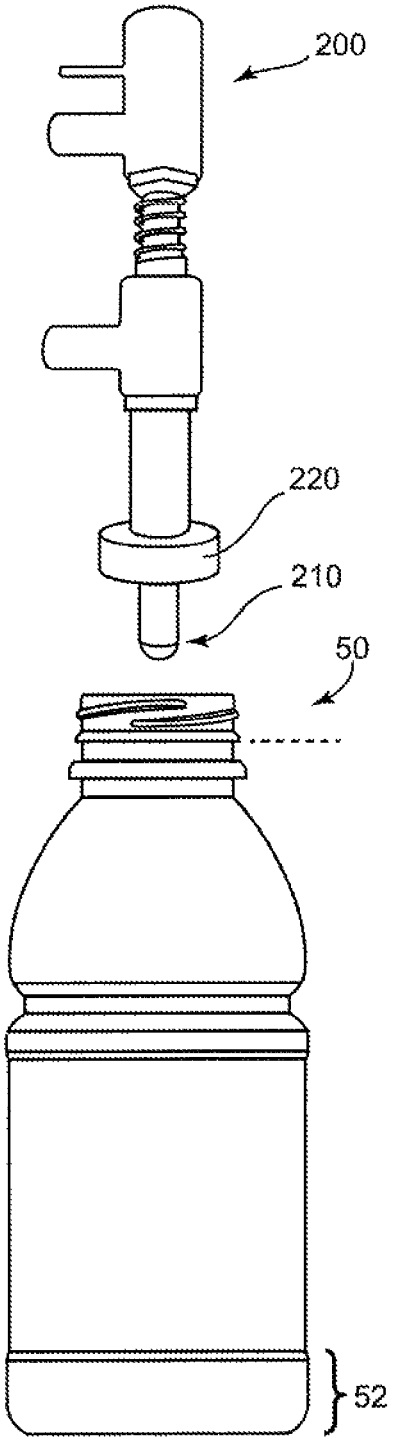
FIG. 17 is a side perspective illustration of an embodiment of a dosing mechanism and container.

As generally illustrated in connection with FIG. 16, system and/or methods of the type disclosed herein may additionally include a step, which may be optional, for injecting or dosing ("dosing") the headspace of a container with contents prior to capping or closure. In embodiments, the headspace may be dosed with an inert gas (e.g., nitrogen in liquid form). An embodiment of a device 200 (which may include a dispensing nozzle) configured for dosing a container is generally illustrated in FIG. 17. The device 200 may comprise, for example and without limitation, a pressure gravity liquid fill to level nozzle that employs a vacuum. As generally illustrated, a dispensing portion, or dispensing nozzle 210, associated with the device may be configured for insertion into a neck/dispensing opening of a container. The device 200 may additionally include a plug or insert 220 that is configured to correspond to a certain size or range of container openings.

The dosing may increase the internal pressure of the container for at least a period of time. With embodiments, upon capping or closure, the internal pressure may, for example, reach 5 to 7 psi. Such an increase in pressure, in combination with the base-forming techniques previously disclosed, may provide a filled container that can withstand increased drop distances and/or vending. Moreover, for some containers, such as those with larger sizes, less vacuum-absorbing features (such as those provided in an upper portion, or dome, of a container) may be necessary or desired.

Conventional nitrogen hot-fill dosing is generally done to build and tightly control pressure in an effort to compensate for an associated liquid cooling vacuum. However, dosings in accordance with the teachings of this disclosure are not necessarily so limited or constrained. That is, embodiments of the disclosed system and method that include such a dosing option need not be concerned with controlling pressure to compensate for a liquid cooling vacuum. Instead, with embodiments of the disclosed system and method, a comparatively much longer time can be left between drop/insertion and capping to eliminate residual pressure because, inter alia, the disclosed system is more concerned with replacing the oxygen of the headspace.

As noted, such dosing may be optional. That is, a system may be configured so that containers may be dosed, or may instead be conveyed to by-pass or skip a dosing step. For some embodiments, a dosing option may only be involved with containers that hold 20 ounces or more. In embodiments that include dosing, the dispensed dosing medium (e.g., liquid nitrogen) may come to rest on the top of the product contents. Depending upon the associated fill level, all or a significant portion of the associated oxygen in the headspace may be eliminated or displaced from the headspace of the sealed container. By providing an oxygen-free or substantially oxygen-free headspace, product quality/life may be increased and, with potentially lower fill levels. For some applications, the use of lower fill levels may improve customer convenience with opening and pouring, as well as possibly providing potential package weight savings.

It is noted that the use of embodiments of the invention may be advantageous with respect to the lightweighting of plastic container for hot-fill applications. Embodiments of the system and process can permit the provision of a plastic container, e.g., a polyethylene terephthalate (PET) container, that due to the handling of internal pressures via the container base portion requires a reduced amount of material in portions of the container and/or may require less (or no) structures, such as vacuum panels, to accommodate anticipated vacuum pressure.

It is also noted that the use of embodiments of the invention may be advantageous with respect to the lightweighting of plastic containers for cold-fill applications, including applications where improved vendability may be desirable. Embodiments of the system and process can provide a plastic container, e.g., a polyethylene terephthalate (PET) container, that given the handling of internal pressures via the container base portion, may require a reduced amount of material in portions of the container and/or may require less (or no) structures or treatment with inert gas to accommodate anticipated drop forces.

Further, embodiments of the system and process can provided for significantly increased efficiencies in a production environment. While just a single system (which may be said to be a unit or station) is illustrated in FIG. 1, embodiments of the invention contemplate devices that provide a plurality of such systems. Embodiments of the invention may provide a system or apparatus that include a plurality of systems for example, a plurality of actuators and base units may be provided in paired equidistantly-spaced, radially-extending sets about the outer periphery of a rotary wheel. With such multi-set systems or apparatus, each individual system (which in this instance may be referred to as a sub-system or station) may include an associated base unit and corresponding actuator. Such a rotary system could includes as many as 6 to 48 sub-systems or more. Further, cycle times for such a rotary system could, for instance, be timed to run at about 4 seconds or 15 revolutions per minute.

The foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. It is intended that the scope of the invention be defined by the claims and their equivalents.

What is claimed is:

1. A system for manufacturing a filled plastic container, the system comprising:

an actuator including a body portion and a holding/securing member configured to hold or secure a portion of said container such that a base portion of said container is not held;

a base unit including a heating surface; and a dispensing device or nozzle;

wherein the actuator is configured to apply a linear force or pressure on said container to contact the base unit; the base unit is configured to receive a base portion of said container that is formed as a unitary structure with the body portion and is configured to support the plastic container on an external surface prior to the application of the linear force or pressure by the actuator, and the base unit is not configured to invert the base portion of said container; the heating surface is configured to convey energy or heat to a portion of the base portion of said container; during the conveyance of energy or heat to the portion of the base portion of said container, the base unit is substantially fixed in the direction of travel of the actuator; and the dispensing device or nozzle is configured to introduce an inert gas into said container.

2. The system of claim 1, wherein the container is comprised of polyethylene terephthalate (PET) and the container is thin-walled.

3. The system of claim 1, wherein the base unit is configured to controllably conduct energy or heat to specific or select portions of the base portion.

4. The system of claim 1, wherein the container is hot-filled and cooled.

5. The system of claim 1, wherein the final filled container internal pressure is within the range of −2.0±1.0 psi to 2.0±1.0 psi.

6. The system of claim 1, wherein the inert gas comprises nitrogen.

7. The system of claim 1, wherein the system is configured to dose and cap the container, and the internal pressure of the container is increased for at least a period of time.

8. The system of claim 7, wherein, upon capping or closure, the internal pressure of the container is from about 5 psi to about 7 psi.

9. The system of claim 1, wherein the system is configured to remove or replace all or a significant portion of oxygen in a headspace of the container.

* * * * *